United States Patent [19]

Rowell

[11] 4,310,971

[45] Jan. 19, 1982

[54] VEGETABLE SLICER

[76] Inventor: Geoffrey D. Rowell, Stuart St., Sydney, N.S.W., Australia, 2211

[21] Appl. No.: 90,060

[22] Filed: Oct. 31, 1979

[30] Foreign Application Priority Data

Nov. 6, 1978 [AU] Australia ..... PD6648

[51] Int. Cl.[3] ..... B26B 3/00

[52] U.S. Cl. ..... 30/279 R; 30/304

[58] Field of Search ..... 30/279 R, 304, 305

[56] References Cited

U.S. PATENT DOCUMENTS

| | | | |
|---|---|---|---|
| 1,551,018 | 8/1925 | Eyre | 30/279 R |
| 1,795,231 | 3/1931 | Perl | 30/279 R |
| 1,803,880 | 5/1931 | Tatham | 30/279 R |
| 2,087,140 | 7/1937 | Coughlan | 30/279 R |
| 2,173,751 | 9/1939 | Burkhart | 30/279 R |
| 2,323,863 | 7/1943 | Feemster | 30/279 R |
| 2,450,346 | 9/1948 | Krilow | 30/279 R |
| 2,450,348 | 9/1948 | Krilow | 30/279 R |
| 2,581,501 | 1/1952 | Shaver | 30/304 |

FOREIGN PATENT DOCUMENTS

| | | | |
|---|---|---|---|
| 13865 | 6/1934 | Australia | 30/279 R |

*Primary Examiner*—Robert C. Watson
*Assistant Examiner*—J. T. Zatarga
*Attorney, Agent, or Firm*—Mahoney & Schick

[57] ABSTRACT

A hand held vegetable slicer has a two part molding which defines a window spanned by an array of blades; both parts have teeth enabling them to interfit to form a comb joint and the ends of the blades are imprisoned between adjacent teeth. In one version the two part molding is a sub-assembly which fits into a window in a preformed handle. In another version the handle has both window and teeth on two opposite edges of the window and a separate toothed molding is used to imprison the blades. ABS plastic and alloy are provided.

6 Claims, 3 Drawing Figures

VEGETABLE SLICER

BACKGROUND OF THE INVENTION

This invention concerns vegetable slicers and especially green bean slicers of the type which are held in the hand like a peeler.

In one known bean slicer there is a plastic handle, a rectangular window in the handle, a metal funnel through which green beans are pushed towards four mutually parallel steel blades spanning the window. Particular attention must be paid to mounting the blades as considerable deflecting forces are imposed thereon when a bean is pulled through them. In the slicer described above the window has a pair of ledges extending from a pair of mutually opposite sides thereof and the ends of each blade are embedded in a block of type metal which sits on a respective ledge. The blocks are clamped in position by overlying metal parts forming the funnel and an external blade holder. The cost of the type metal required for the blocks is relatively high and the casting step by which the molten metal embeds the jig-assembled blades imposes manufacturing constraints which this invention seeks to mitigate.

OBJECTS AND SUMMARY OF THE INVENTION

According to this invention there is provided a hand held vegetable slicer having a two part plastic molding which defines a window spanned by blades through which the material to be sliced may pass wherein both parts have teeth enabling the parts to interfit to form a comb joint and the ends of the blade are imprisoned in the gaps between adjacent teeth.

The upper and lower parts may each comprise a substantially flat, channel-shaped molding with a bridge piece and limbs from which teeth project so that when the parts are pressed together they form a rectangular frame which fits as a sub-assembly into the window molded in the handle.

Preferably the sides of those teeth which imprison the blades are suitably inclined to ensure that the blades lie in diverging positions whereby the resistance to the slivers of vegetable tissue passing between them is reduced.

The upper and lower parts may be pierced by locating pins and may be connected as a sub-assembly by welding.

In the preferred construction one of the parts forms the handle of the slicer and the teeth are arranged on two mutually opposite sides of the window. The remaining complementary part has two limbs and a bridge piece as described above. After the two parts are assembled with the blades imprisoned in their correct positions between the two parts, a high frequency welding operation ensues and the boundary between the two parts becomes less evident or disappears as the polymer softens in the region of the boundary. The specific embodiments which are next described relate chiefly to the construction of the slicer during manufacturing stages.

BRIEF DESCRIPTION OF THE DRAWING

Certain embodiments of the invention will now be described by way of example with reference to the accompanying drawings in which.

DESCRIPTION OF THE BEST EMBODIMENTS CONTEMPLATED

Figure 1:
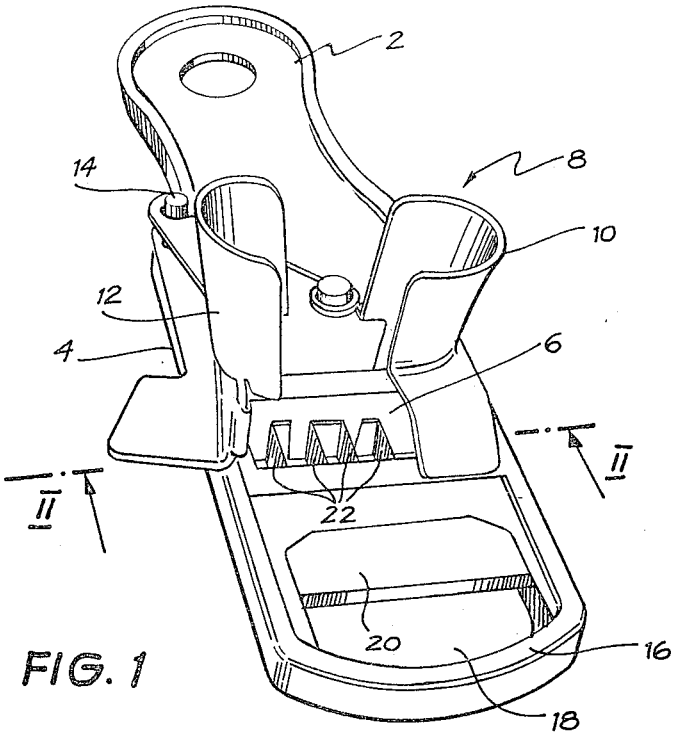
FIG. 1 is a perspective view of the vegetable slicer with the funnel opened to its maximum extent to reveal the blades spanning the window.

Referring now to FIG. 1, the slicer has a handle 2, a body 4 and a window 6 in the body. Above the window is a metal funnel 8 made of a fixed half 10 and a tiltable half 12 which latter is mounted on a pivot pin 14 molded in the handle 2. The end of the body 4 is extended by an arcuate guard 16 which defines a space 18 into which the end of the bean may be inserted for the purpose of tailing it with blade 20. Four mutually parallel steel blades 22 span the window 6.

Figure 2:
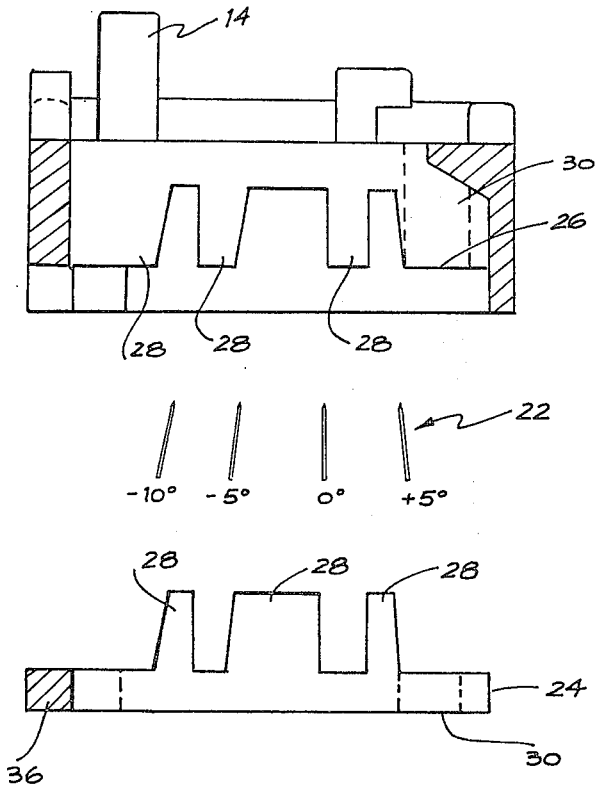
FIG. 2 is a sectional exploded view of the parts on line 1—1 with the blades suspended between the parts.

Referring now to FIG. 2, it will be seen that the handle, body and the window in the body constitute an upper part and the molding 24 constitutes a lower part. The two mutually parallel transverse edges 26 (only one shown) of the window are each provided with three downwardly directed flat-bottomed teeth 28. The depth of the teeth is equal to the depth of the bean cutting blades 22, that is about 5 mm. The molded lower part 24 has complementary teeth 28. Both moldings fit together with a clearance between adjacent teeth of about 8 thou. which is the thickness of a blade. Both moldings are pierced by a pair of bores 30 (only one shown) which mutually register when the two moldings are assembled. The bores receive the pins (not shown) of the funnel half 10.

The inclination of the blades 22 is shown in FIG. 2. The angles which the blades take up in the device is important. Experience shows that the indicated angles are successful for green beans. During assembly the blades are laid across the window, the bottom molding is pressed into position and the pins of the funnel half 10 are pushed through bores 30. The assembly is then placed in a high frequency welding station which irreversibly connects the two moldings. The boundary between the moldings is indicated in FIG. 1 only for the purpose of explanation.

Figure 3:
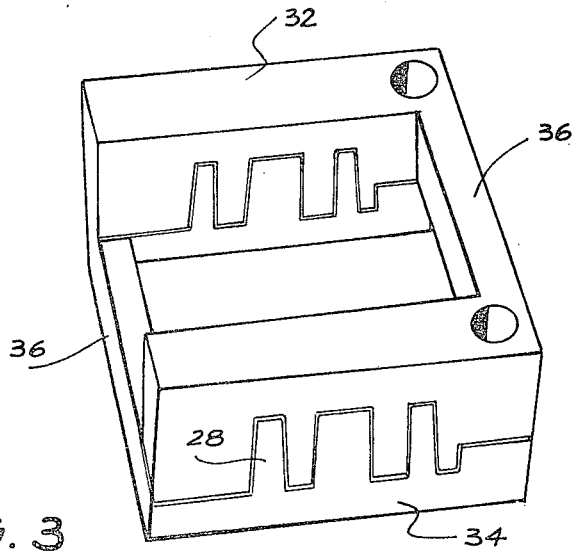
FIG. 3 shows the parts when provided as a sub-assembly for insertion into the window of a preformed handle.

Referring now to FIG. 3, in an alternative construction the window 6 has two mutually parallel sides and two inclined sides (not shown). The window 6 receives a four-sided sub-assembly consisting of a top channel section molding 32 and a bottom channel section molding 34. Each has two limbs and a bridge piece 36. The center portions of the limbs each have three flat-bottomed teeth and it will be seen that this assembly holds blades in exactly the same manner as the embodiment shown in FIG. 2. The right hand ends of the limbs are bored to receive the locating pins which extend from the fixed half 10 of the funnel during assembly and the sub-assembly is welded together and clamped into the window by overlying metal parts, not shown, associated with the funnel.

We have found the advantages of the above embodiments to lie in the reduction in cost of materials, simplification of manufacture; maintenance of blade angle; the ability to utilize blades of slightly differing depth such as result from commercial grinding processes. Although ABS plastic is advantageous, die casting alloy may be substituted.

I claim:

1. A vegetable slicer comprising a hand held, molded plastic body part which defines a window through which material to be sliced may pass, a series of side by side spaced blades spanning the window, each of which blades have two ends, a molded plastic retainer part which cooperates with the body part in retaining and supporting the series of side by side blades such that only the ends of the blades are supported when the two parts are assembled, wherein the body part has two mutually opposite sets of teeth adjacent the window and the retainer part has two corresponding complementary sets of teeth, which sets interfit to form a comb joint between the two parts when the latter are brought together in alignment, the ends of the blades each being imprisoned between mating surfaces of pairs of adjacent teeth.

2. A vegetable slicer as claimed in claim 1 wherein the window is rectangular and the retainer part is a substantially flat, U-shaped molding with a bridge piece connecting two limbs, each limb having a set of teeth.

3. A vegetable slicer as claimed in claim 1 wherein the mating surfaces of teeth which support and imprison the ends of one blade are disposed at a different inclination from those which support and imprison the ends of the next adjacent blade whereby the blades lie in a diverging array in relation to the passage of the material to be sliced.

4. A vegetable slicer as claimed in claim 1 wherein the two parts are held together and the comb joint maintained by pins which pass through the parts and are fused to the parts by high frequency welding.

5. A vegetable slicer comprising a hand held, molded plastic body defining an aperture, a flat, two-part molded plastic frame positioned in said aperture and in turn defining a window through which material to be sliced may pass, a series of side by side spaced blades spanning said window and each having two ends, one frame part having two mutually opposite sets of teeth adjacent the window and the other frame part having two corresponding complementary sets of teeth whereby prior to reception into the body aperture, the two frame parts interfit when superimposed and pressed together to form a comb joint which imprisons the ends of the blades between mating surfaces of adjacent teeth of the joint.

6. A vegetable slicer as claimed in claim 5 wherein the window is rectangular and the two frame parts are both of U-shape with a bridge piece and a pair of parallel limbs, each limb having a set of teeth.

* * * * *